US006150648A

United States Patent [19]

Kang et al.

[11] Patent Number: 6,150,648

[45] **Date of Patent: *Nov. 21, 2000**

[54] AIR CIRCULATION STRUCTURE FOR MICROWAVE OVEN

[75] Inventors: Jong-Soo Kang; Dong-Wan Seo, both of Changwon, Rep. of Korea

[73] Assignee: LG Electronics, Inc., Rep. of Korea

[ * ] Notice: This patent issued on a continued prosecution application filed under 37 CFR 1.53(d), and is subject to the twenty year patent term provisions of 35 U.S.C. 154(a)(2).

[21] Appl. No.: 09/192,606

[22] Filed: Nov. 15, 1998

[30] Foreign Application Priority Data

Nov. 15, 1997 [KR] Rep. of Korea ..... 97-60244

[51] Int. Cl.[7] ..... H05B 6/72

[52] U.S. Cl. ..... 219/757; 219/756; 219/748; 126/198

[58] Field of Search ..... 219/757, 756, 219/746, 748; 126/21 A, 198

[56] References Cited

U.S. PATENT DOCUMENTS

| | | | |
|---|---|---|---|
| 4,184,945 | 1/1980 | Morgan et al. | 219/757 |
| 4,332,992 | 6/1982 | Larsen et al. | 219/757 |
| 4,350,859 | 9/1982 | Dudley et al. | 219/757 |
| 4,743,728 | 5/1988 | Nagsfusa et al. | 219/757 |

FOREIGN PATENT DOCUMENTS

| | | | |
|---|---|---|---|
| 186104 | 12/1985 | European Pat. Off. . | |
| 3608432 | 3/1986 | Germany . | |
| 8602143 | 10/1985 | Japan . | |
| 61-125526 | 6/1986 | Japan . | |
| 61-186722 | 8/1986 | Japan | 219/757 |
| 61-272526 | 12/1986 | Japan | 219/757 |
| 1-219422 | 9/1989 | Japan | 219/757 |
| 5-332557 | 12/1993 | Japan | 219/757 |

OTHER PUBLICATIONS

European Search Report—Oct. 13, 1999.

*Primary Examiner*—Philip H. Leung
*Attorney, Agent, or Firm*—Ostrolenk, Faber, Gerb & Soffen, LLP

[57] ABSTRACT

An air circulation structure for a microwave oven is disclosed. The structure includes a fan for sucking air into the interior of a machinery compartment installed below a cooking chamber of the microwave oven, a bottom plate having an air suction port through which an air sucked by the fan and radiating heat generated from the electrical elements of the microwave oven is flown into the interior of the cooking chamber, and a rear surface plate having a first air discharge port through which the air passed through an air suction port formed on the bottom plate and circulated in the interior of the cooking chamber is discharged to the outside of the microwave oven, for thereby effectively radiating heat from electrical elements of a microwave oven having a machinery chamber installed below a cooking chamber and dehumidifying from the interior of the cooking chamber.

4 Claims, 2 Drawing Sheets

AIR CIRCULATION STRUCTURE FOR MICROWAVE OVEN

BACKGROUND OF THE INVENTION

1. Field of the Invention

The present invention is directed to a microwave oven, and in particular to an air circulation structure for a microwave oven which is capable of effectively radiating heat from electrical elements and dehumidifying from a cooking chamber by enabling an effective easier air circulation in a microwave oven having a machinery compartment below the cooking chamber.

2. Description of the Conventional Art

Generally, the microwave oven is directed to cooking foods using microwaves generated by a microwave generation source and is formed of a door, a cooking chamber in which foods are cooked, and a machinery compartment having various elements therein.

In the thusly constituted microwave oven, an air circulation structure is formed for quickly radiating heat from a magnetron and a high voltage transformer installed in the machinery compartment and externally introducing air into the interior of the microwave oven for discharging a high temperature vapor generated in the interior of the cooking chamber during a cooking operation to the outside.

As shown in FIGS. 1 and 2, in the conventional air circulation structure for a microwave oven, a suction guide member 7 sucking air from the outside of the microwave oven is formed on an inner surface of a back plate 4, and a fan 8 sucking air from the outside of the microwave oven is installed at the suction guide member 7.

The fan 6 generating a predetermined suction force for sucking air from the outside of the microwave oven is driven by a fan motor 6M.

In addition, in the machinery compartment 11 formed on an outer lateral surface of a cavity 1, an air duct 8 is installed for guiding the external air cooled the magnetron 9 into the interior of the cooking chamber 3.

In the drawings, reference numeral 2 represents a door, 5 represents an air suction port, and 10 represents a high voltage transformer.

The air circulation by the air circulation structure for a conventional microwave oven will be explained with reference to the accompanying drawings.

In the air circulation structure for a conventional microwave oven, when the fan motor 6M is driven for thereby rotating the fan 6 and then generating a predetermined suction force, air is introduced into the interior of the microwave oven through the air suction port 5 formed in the back plate 4.

The air introduced into the interior of the microwave oven is guided by the suction guide member 7 formed on the inner surface of the back plate 4 and is flown to the magnetron 9 and the high voltage transformer 10 for thereby cooling the magnetron 9 and the high voltage transformer 10, and then is flown into the interior of the cooking chamber 3 through the air duct 8.

The air flown into the interior of the cooking chamber 3 is discharged, together with the vapor in the cooking chamber 3, to the outside of the cooking chamber 3 for thereby removing vapor from the cooking chamber 3.

However, since the air circulation structure for the conventional microwave oven includes a machinery compartment provided on a lateral surface of the microwave oven, the conventional air circulation structure is not applicable for the microwave oven formed in various structures.

SUMMARY OF THE INVENTION

Accordingly, it is an object of the present invention to provide an air circulation structure for a microwave oven which overcomes the aforementioned problems encountered in the conventional art.

It is another object of the present invention to provide an air circulation structure for a microwave oven which is capable of effectively radiating heat from electrical elements of a microwave oven having a machinery chamber installed below a cooking chamber and dehumidifying from the interior of the cooking chamber.

To achieve the above objects, there is provided an air circulation structure for a microwave oven which includes a fan for sucking air into the interior of a machinery compartment installed below a cooking chamber of the microwave oven, a bottom plate having an air suction port through which an air sucked by the fan and radiating heat generated from the electrical elements of the microwave oven is flown into the interior of the cooking chamber, and a rear surface plate having a first air discharge port through which the air passed through an air suction port formed on the bottom plate and circulated in the interior of the cooking chamber is discharged to the outside of the microwave oven.

Additional advantages, objects and features of the invention will become more apparent from the description which follows.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

The embodiments of the present invention will be explained with reference to the accompanying drawings.

Figure 1:
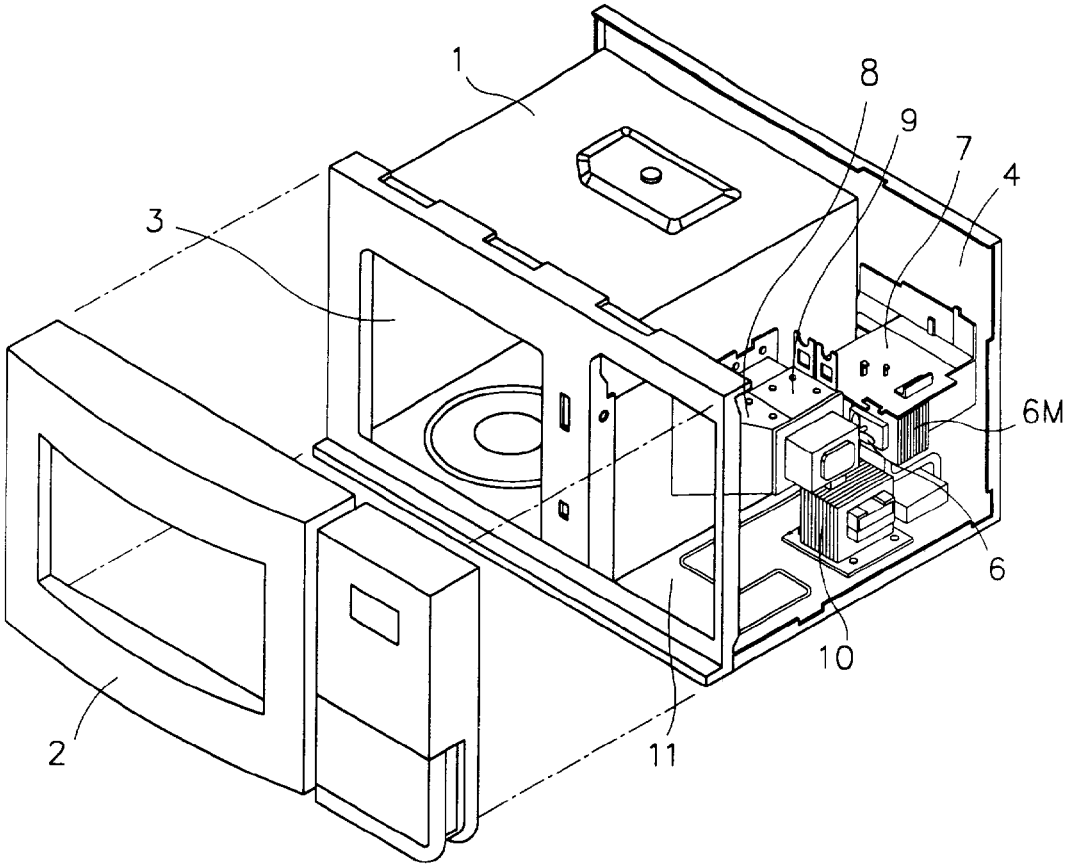
FIG. 1 BACKGROUND ART
FIG. 1 is a perspective view illustrating an inner structure of a conventional microwave oven in which a machinery compartment is installed at a lateral surface of a cooking chamber.
Figure 2:
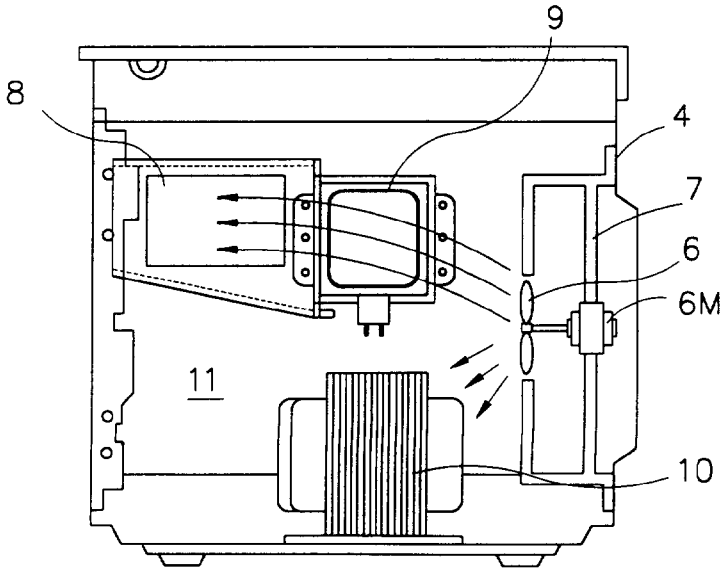
FIG. 2 BACKGROUND ART
FIG. 2 is a view illustrating an air flow by an air circulation structure for a conventional microwave oven.
Figure 3:
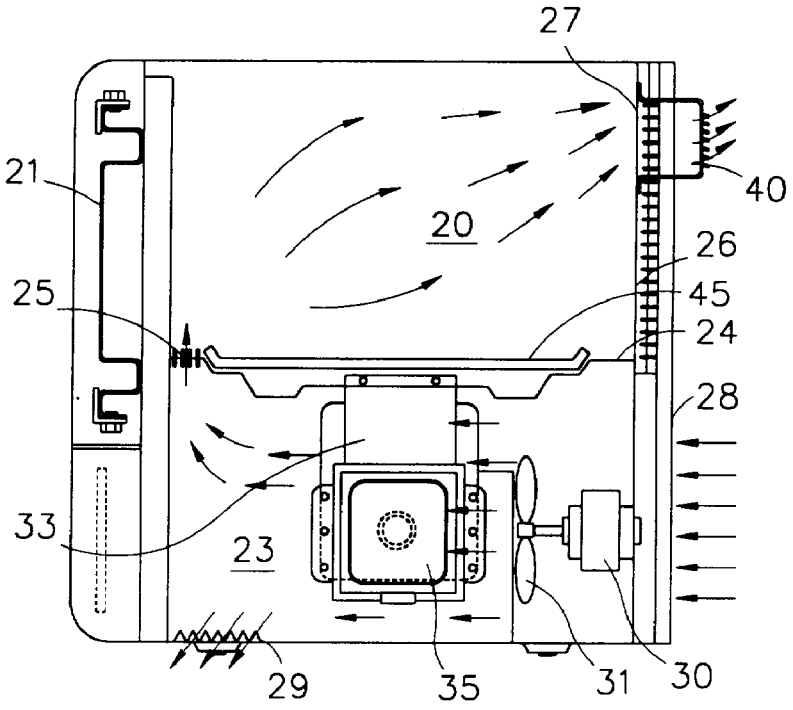
FIG. 3 is a side cross-sectional view illustrating an air circulation structure for a microwave oven according to the present invention.
Figure 4:
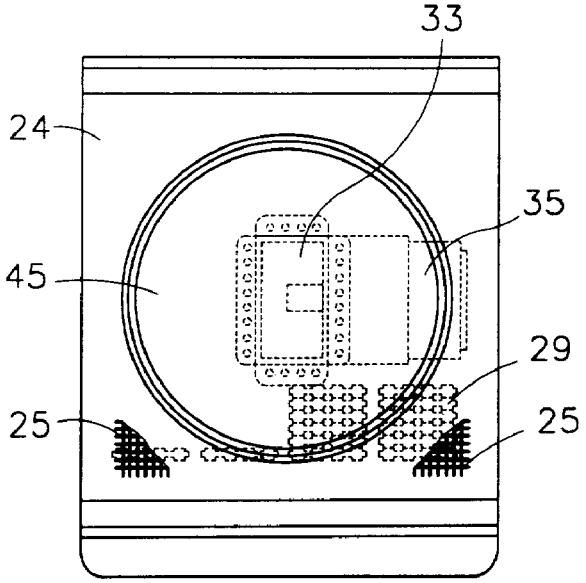
FIG. 4 is a plan cross-sectional view illustrating an air circulation structure for a microwave oven according to the present invention.

In the air circulation structure for a microwave oven according to the present invention, as shown in FIGS. 3 and 4, there are provided a fan 31 and a fan motor 30 for driving the fan 31 inside a base plate 28. A microwave guide member 33 is formed below a bottom plate 24 of a cooking chamber 20.

In addition, a magnetron 35 is installed on a lateral surface of the wave guide member 33 for generating microwaves, with its lateral surface being opposite to the fan 31.

As shown in FIG. 4, a suction port 25 is formed at an end portion of the bottom plate 24 forming the bottom of the cooking chamber 20 for flowing the air sucked by the fan 31 into the cooking chamber 20 therethrough.

The suction port 25 is formed near the door 21 for preventing dew from being condensed on the inner surfaces of the door and effectively circulating air inside the cooking chamber 20.

In addition, a first air discharge port 27 is formed at an upper portion of the rear plate forming the rear surface of the cooking chamber 20 for flowing the air circulated inside the cooking chamber 20 to the outside therethrough for thereby effectively circulating the air of a high temperature in the cooking chamber 20.

A discharge guide member 40 is formed on an outer portion of the rear plate, in which the first air discharge port 27 is formed, for thereby guiding a discharge of the air through the first air discharge port 27.

The discharge guide member 40 is directed to effectively discharging the air even when the microwave oven is installed near the wall of a house or a building by obtaining enough space between the wall and the rear surface of the microwave oven for thereby implementing an effective external suction of air.

In addition, a second air discharge port 29 is formed on the base plate 28 forming the bottom surface of the machinery compartment 23 for discharging the air heated while passing through the magnetron to the outside.

In the drawings, reference numeral 10 represents a rear surface plate, and 45 represents a tray.

The circulation of the air based on an air circulation structure according to the present invention will be explained with reference to the accompanying drawings.

Namely, in the air circulation structure for a microwave oven according to the present invention, when electric power is supplied to the microwave oven, the cooking operation is started in the cooking chamber 20, and the fan motor 30 is driven, and the fan 31 is rotated. Therefore, air is forcibly introduced from the outside of the microwave oven into the machinery compartment 23 by the rotation force of the fan 31, and the thusly introduced air passes trough the magnetron 35, the high voltage transformer, etc. for thereby radiating heat therefrom.

A part of the air passed through the magnetron 35 and the high voltage transformer is discharged to the outside of the microwave oven through the second air discharge port 29 formed on the base plate 28 forming the bottom surface of the machinery compartment 23, and the remaining air is flown into the interior of the cooking chamber 20 through the suction port 25 formed at the end portion of the bottom plate 24 forming the bottom surface of the cooking chamber 20.

The air flown into the cooking chamber 20 circulates inside the cooking chamber 20 and sucks vapor in the interior of the cooking chamber 20. At this time, the air flown into the interior of the cooking chamber 20 is heated by a high temperature air in the interior of the cooking chamber 20 and is flown from the lower portion to the upper portion inside the cooking chamber and then is discharged through the first air discharge port 27 formed on the upper end portion of the rear surface plate forming the rear surface of the cooking chamber 20 and is discharged to the outside of the microwave oven by the guide of the discharge guide member 40.

In addition, since the suction port 25 is formed at an end portion of the bottom plate 24 of the cooking chamber 20, when air is externally introduced thereinto through the suction port 25, a part of the thusly introduced air is upwardly flown along the inner surface of the door 21.

Here, the above-described flow of the air may help removing the vapor moving along the inner surface of the door 21 for thereby preventing a dew condensation on the inner surface of the door 21.

As described above, in a microwave oven having a machinery compartment below the cooking chamber, it is possible to more effectively suck air into the interior of the microwave oven for thereby enhancing a radiating operation of high temperature air generated from the parts such as a magnetron, etc. compared to the conventional art.

In addition, in the present invention, it is possible to prevent a dew condensation on the inner surface of the door by installing a suction port at the upper portion of the cooking chamber, so that the vapor in the interior of the cooking chamber is effectively removed by the air flown into the cooking chamber.

Although the preferred embodiments of the present invention have been disclosed for illustrative purposes, those skilled in the art will appreciate that various modifications, additions and substitutions are possible, without departing from the scope and spirit of the invention as recited in the accompanying claims.

What is claimed is:

1. A microwave oven including a machinery compartment installed below a cooking chamber of the microwave oven, a door for the passing of food into the microwave oven, and an air circulation structure, the air circulation structure comprising:

a fan for sucking air into the interior of the machinery compartment;

a bottom plate having an air inlet port located adjacent the microwave oven door, through which air sucked by the fan and radiating heat generated from the electrical elements of the microwave oven is directed into the interior of the cooking chamber and adjacent the door to prevent dew from forming on the door; and a rear surface plate having a first air discharge port through which the air passed through the air inlet port formed on the bottom plate and circulated in the interior of the cooking chamber is discharged to the outside of the microwave oven.

2. The structure of claim 1, wherein said air inlet port and said first air discharge port are formed at an end portion of the bottom plate and an upper portion of the rear surface plate for thereby promoting natural circulation of air in the interior of the cooking chamber.

3. The structure of claim 1, wherein a discharge guide member is formed at a portion corresponding to the first air discharge port for guiding the air discharged from the cooking chamber to the outside of the microwave oven.

4. The structure of claim 1, wherein a second air discharge port is formed on a lower surface of the machinery compartment installed below the cooking chamber for discharging the air radiating the heat from the electrical elements to the outside of the microwave oven therethrough.

* * * * *